US009462907B2

(12) United States Patent
Harman, II

(10) Patent No.: US 9,462,907 B2
(45) Date of Patent: Oct. 11, 2016

(54) APPARATUS AND METHOD FOR ATTACHING A DECORATIVE FIXTURE TO A TREE TOP

(76) Inventor: Thomas MacMartin Harman, II, Portola Valley, CA (US)

( * ) Notice: Subject to any disclaimer, the term of this patent is extended or adjusted under 35 U.S.C. 154(b) by 27 days.

(21) Appl. No.: 13/207,706

(22) Filed: Aug. 11, 2011

(65) Prior Publication Data

US 2012/0040110 A1 Feb. 16, 2012

Related U.S. Application Data

(60) Provisional application No. 61/373,367, filed on Aug. 13, 2010.

(51) Int. Cl.
*A47B 96/06* (2006.01)
*A47G 33/10* (2006.01)

(52) U.S. Cl.
CPC ..... *A47G 33/10* (2013.01); *Y10T 29/49948* (2015.01)

(58) Field of Classification Search
CPC ..... A47G 33/06; A47G 33/08; F21S 4/001
USPC ..... 248/220.21; 428/19, 7, 20; 362/123
See application file for complete search history.

(56) References Cited

U.S. PATENT DOCUMENTS 1,543,424 A * 6/1925 Cowles ..... A47G 33/08 362/121
3,031,785 A * 5/1962 Carlson ..... A47G 33/06 428/8
3,118,617 A * 1/1964 Hellrich ..... A47G 33/06 315/191
3,206,593 A * 9/1965 Winnicki, Sr. ..... A47G 33/06 362/123
3,677,867 A * 7/1972 Westlund ..... 428/9
4,101,697 A * 7/1978 Dieffenbach ..... A47G 33/06 428/20
4,462,065 A * 7/1984 Rhodes ..... 362/249.18
4,526,819 A * 7/1985 Murray ..... A47G 33/0863 428/10
5,071,098 A * 12/1991 Aldridge ..... A47F 5/04 248/219.2
5,085,901 A * 2/1992 Johnson et al. ..... 428/19
5,609,412 A * 3/1997 Contigiani ..... F21S 4/001 362/123
5,746,504 A * 5/1998 Dodson ..... F21S 4/001 362/123
5,772,166 A * 6/1998 Adams ..... F21V 21/08 248/229.16
6,027,228 A * 2/2000 Adams ..... A47G 33/06 362/121
6,037,021 A * 3/2000 Koo ..... 428/10
6,224,231 B1 * 5/2001 Personius ..... F21S 4/001 362/123
6,663,921 B1 * 12/2003 Quigel ..... 428/12
7,445,823 B2 * 11/2008 Tennison ..... A47G 33/06 362/123
8,087,796 B2 * 1/2012 Golembiowski ..... F21S 4/003 362/122
8,801,227 B1 * 8/2014 Loomis ..... F21V 21/088 362/249.19
2010/0000065 A1 * 1/2010 Cheng et al. ..... 29/428
2014/0321130 A1 * 10/2014 Loomis ..... F21V 21/088 362/311.13

* cited by examiner

*Primary Examiner* — Monica Millner
(74) *Attorney, Agent, or Firm* — Tarolli, Sundheim, Covell & Tummino LLP

(57) ABSTRACT

A kit for securing a tree topper to a tree includes an extension member for receiving the tree topper includes a body having a first end and a second end. The body includes at least one opening positioned between the first end and the second end. At least one fastener extends through at least one of the openings to secure the extension member to the tree.

19 Claims, 7 Drawing Sheets

APPARATUS AND METHOD FOR ATTACHING A DECORATIVE FIXTURE TO A TREE TOP

RELATED APPLICATION

This application claims the benefit of U.S. Provisional Application No. 61/373,367, filed Aug. 13, 2010, the entirety of which is incorporated herein by reference.

TECHNICAL FIELD

The invention relates to an apparatus, kit, and method for attaching a decorative fixture to the top of a tree.

BACKGROUND

There are various types of decorations that people place on the top of trees and, in particular, on top of Christmas trees. It can be difficult, however, to place and maintain the decoration on the top of the tree in a desired orientation. More specifically, due to several factors such as space constraints, deterioration of the decorative tree topper over time, and the tree top geometry, it may be difficult to place or maintain the tree topper in the desired location atop the tree. Therefore, there is a need in the art for a device that securely maintains a decorative tree topper in a desired location atop a tree.

SUMMARY OF THE INVENTION

According to one embodiment, a kit for securing a tree topper to a tree includes an extension member for receiving the tree topper includes a body having a first end and a second end. The body includes at least one opening positioned between the first end and the second end. At least one fastener extends through each opening to secure the extension member to the tree.

In accordance with another embodiment, an extension member for securing a tree topper to a tree includes a body that extends along a centerline from a first end to a second end. The first end is secured to the tree and the second end is secured to the tree topper. At least one opening is positioned between the first end and the second end for securing the body to the tree. Each of the openings extends in a direction that is offset from the centerline of the body.

In accordance with another embodiment, a method of positioning a tree topper on a top of a tree includes providing an extension member that includes a body having a first end and a second end, the body including at least one receptacle positioned between the first end and the second end. A fastener is inserted through at least a portion of the receptacle to secure the extension member to the tree. The tree topper is placed on the extension member to position the tree topper on top of the tree.

DETAILED DESCRIPTION

The invention relates to an apparatus, kit and method for attaching a decorative fixture to the top of a tree. The apparatus can be provided as a kit that a user can attach to the top of a real or artificial tree in order to securely connect the tree topper to the tree. As an example, a real tree may constitute any variety of tree that is grown on a farm or in a nursery, a tree found naturally in the forest or a potted tree at one's home or business.

Figure 1:
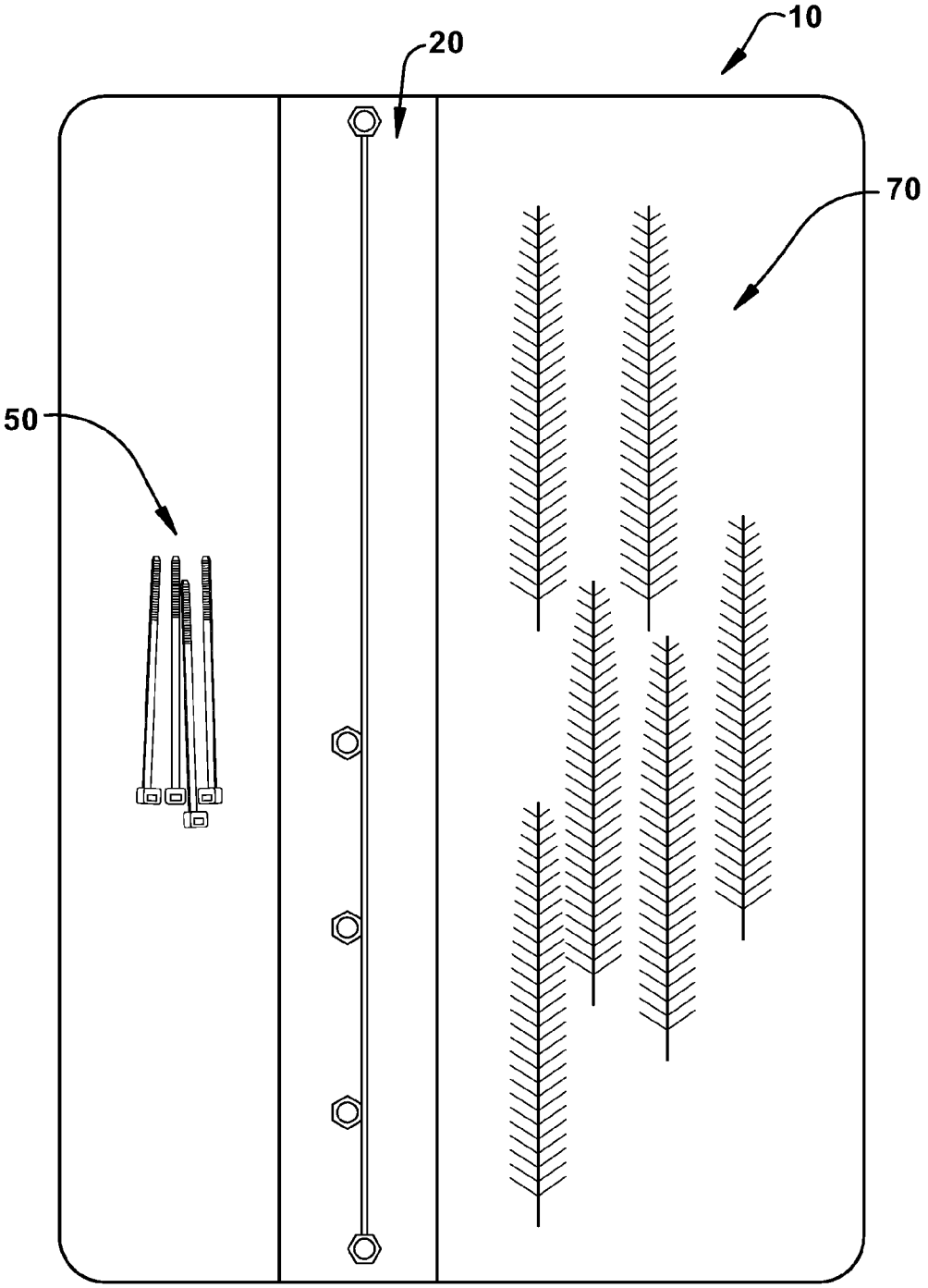
FIG. 1 illustrates a schematic illustration of an example of a kit for securing a tree topper to a tree top.

FIG. 1 illustrates an example of a tree topper extension kit 10. The kit 10 includes a tree topper extension member 20, one or more fasteners 50 for securing the extension member to a tree, and fill material 70 for filling any gaps between the extension member and a tree topper (not shown) placed thereon.

Figure 2:
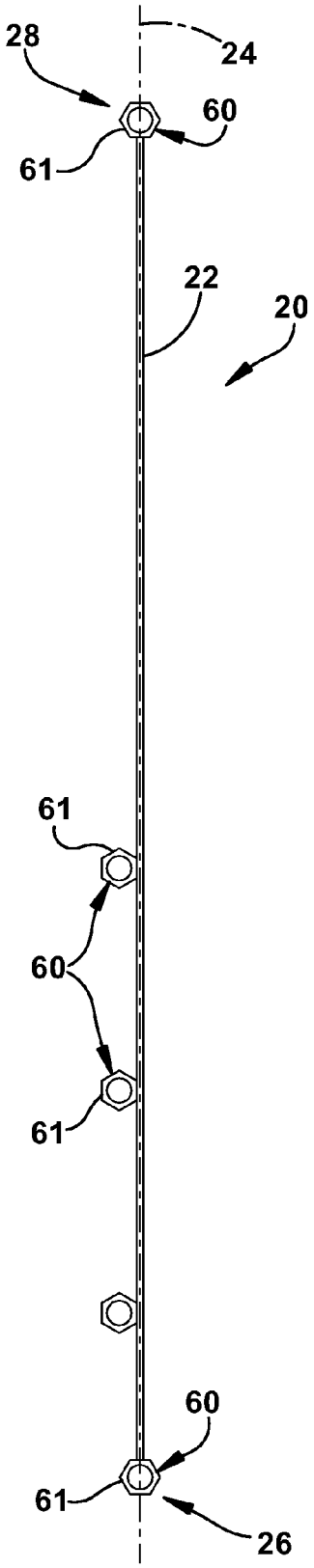
FIG. 2 illustrates an example of a tree topper extension of the kit of FIG. 1.

The extension member 20 is illustrated in FIG. 2 and includes an elongated body 22 that extends along a centerline (e.g., central longitudinal axis) 24 from a first or proximal end 26 to a second or distal end 28. The extension member 20 can be formed of a substantially rigid material, such as plastic or metal, and can have a length of, for example, about 12 inches to about 36 inches. The length of the extension member 20 varies depending on the height of the tree topper and the tree on which the extension member is used. The material of the extension member 20 can be inelastically deformable such as to allow the extension member to be shaped and held in a desirable shape or orientation for placement atop the tree. As an example, the distal end 28 of the body 22 may include a complete loop that can be shaped, e.g., bent, to a desired shape that corresponds to the configuration of a receptacle of the tree topper. In this way, the distal end can hold the tree topper at a desired orientation (e.g., vertical) when mounted on the extension member. The extension member 20 can be formed or painted to exhibit a desired color such as, for example, the green color of the tree or brown color of the tree trunk.

One or more openings 60 can be provided in the body 22 of the extension member 20 for helping to secure the extension member to the tree. The openings 60 may constitute passages extending entirely through tabs or extensions 61 of the base 22 or the openings may be in the form of loops, notches or hooks secured to or formed integrally with the body. Although a series of tabs 61 are illustrated in the example of FIG. 2, it will be appreciated that other fastening structures, e.g., hooks, loops, ribs, ridges, Velcro®, clasps or the like, may be provided along the length of the extension member 20 to help secure the extension member to the tree.

In any case, the openings 60 can extend in a direction that is offset from, i.e., does not intersect, the centerline 24 of the base 22. The openings 60 may be positioned along the length of the extension member 20 in a predetermined pattern. As shown in FIG. 2, an opening 60 is provided at both the proximal end 26 and the distal end 28 of the extension member 20 and additional openings are positioned closer to the proximal end. The openings 60 may have any spatial configuration about the body 22 of the extension member 20. For example, the openings 60 may be oriented on one side of the centerline 24 of the body 22 or radially spaced about the centerline in a random or predetermined pattern. The openings 60 may be positioned in substantially the same plane or in different planes. The openings 60 can have the same size or may have different sizes.

Figure 3:
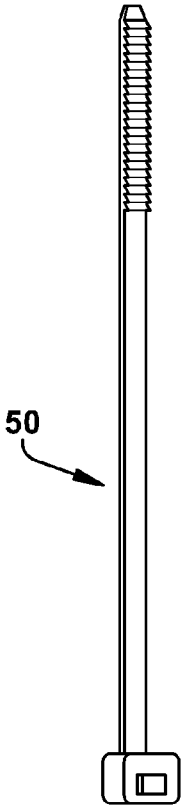
FIG. 3 illustrates an example of a fastener of the kit of FIG. 1.

FIG. 3 illustrates an example of one of the fasteners 50 in the kit 10 used to secure the extension member 20 to the tree. The fasteners 50 can constitute zip ties, as shown, but may alternatively include other types of fasteners such as wires or twisty-ties, clips, clamps, Velcro® or the like. In any case, the fasteners 50 can be configured to provide a releasable connection between the extension member 20 and the tree.

The fill material 70 (FIG. 1) of the kit 10 can be used to tighten the fit between the tree topper and the extension member 20 to stabilize the tree topper atop the tree. For instance, the fill material 70 can be lengths of artificial tree branches that are inserted into the underside of the tree topper to create a tighter fit and connection between the tree topper and the extension member 20. Any material that can be inserted into the tree topper together with the extension member may suffice as fill material in the kit 10, e.g., paper, foam, cardboard, artificial tree branches or the like.

Figure 4:
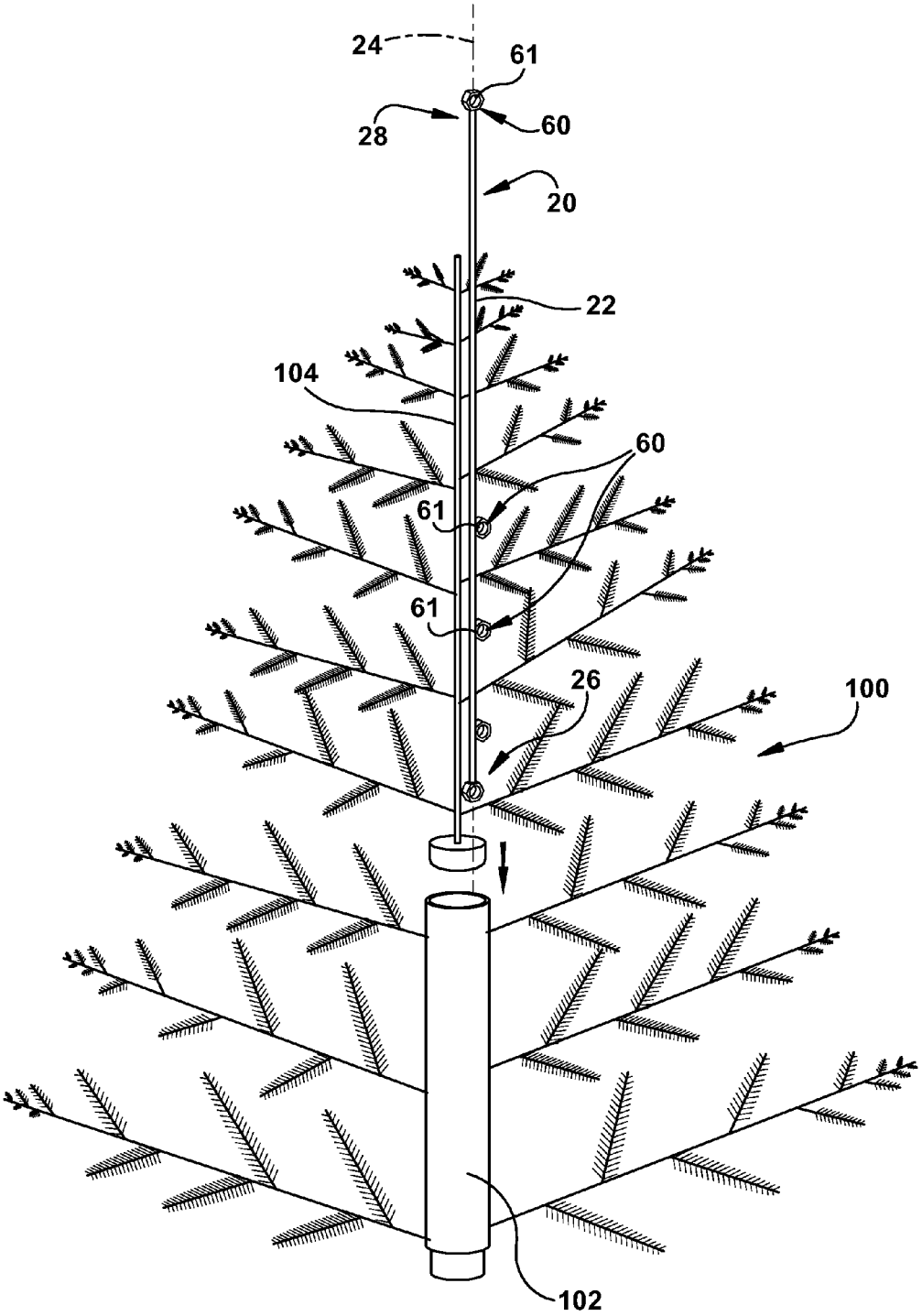
FIG. 4 illustrates an example of the tree topper extension being positioned along the trunk of the tree.
Figure 5:
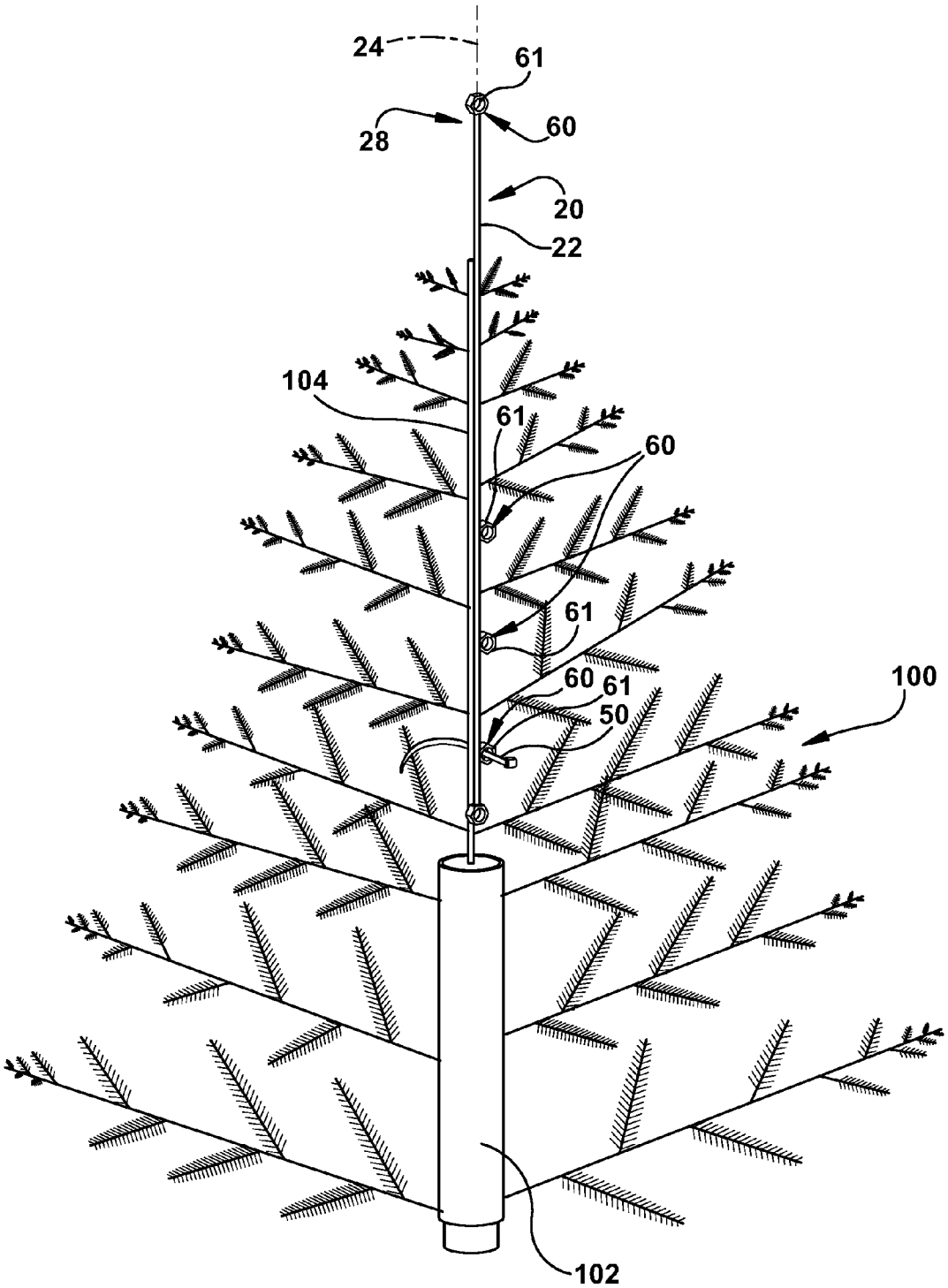
FIG. 5 illustrates an example of the tree topper extension being secured to the tree.
Figure 6:
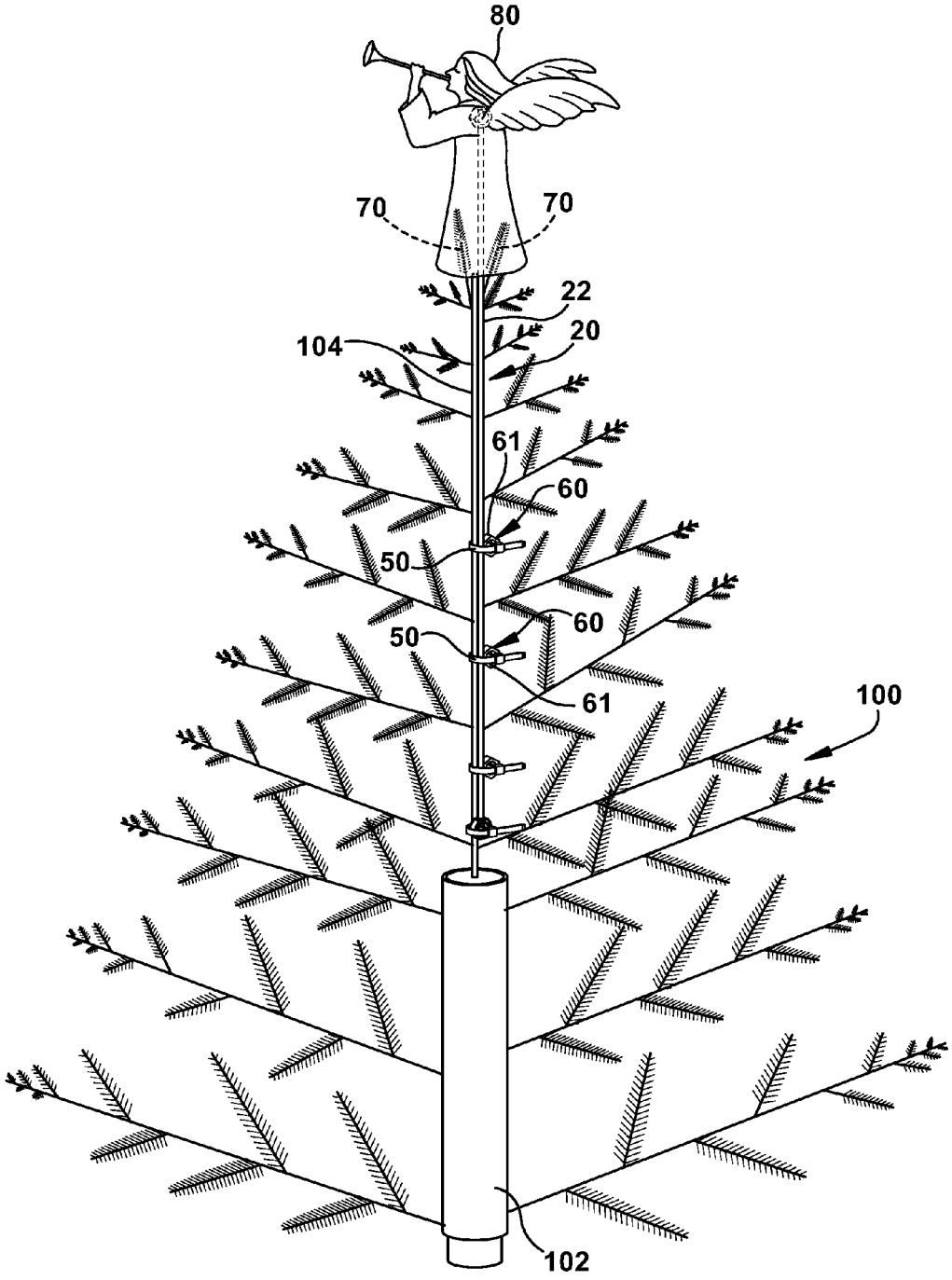
FIG. 6 illustrates an example of the tree topper placed on the tree topper extension and stabilizing the tree topper with the tree topper extension using fill material.

FIGS. 4-6 illustrate a method of using the tree topper kit 10 in accordance with the invention. In FIG. 4, the extension member 20 is placed against a trunk 102 of a tree 100 with the end of the extension member that includes multiple openings 60, i.e., the proximal end 26, extending toward the ground. The extension member 20 can be adjusted relative to a top 104 of the tree 100 to a desired position depending on the style, shape, and weight of the tree topper.

In FIG. 5, the fasteners (e.g., zip ties) 50 are fed through one or more of the openings 60, around the trunk 102 of the tree 100, and fastened to secure the extension member 20 to the tree. Each opening 60 used may receive a single fastener 50 or multiple fasteners. In one example, two or more zip ties 50 and two openings 60 can be used to ensure a secure attachment between the extension member 20 and the tree 100. In the case of zip ties as the fasteners 50, once the zip ties are secure, the excess length of the ends of each zip tie can be trimmed off by using a pair of scissors, nail clippers or the like (not shown).

After the extension member 20 is securely fastened to the tree 100, a tree topper 80 can be positioned on the distal end 26 of the extension member 20 such as shown in FIG. 6. The tree topper 80 may be, for example, a figurine or shape and may have a holiday theme. In one example, the tree topper 80 exhibits a Christmas theme and constitutes an angel, cross, star or the like. In any case, depending on the size and shape of the tree topper 80 and the extension member 20, there may be excess space between the extension member and the interior or underside of the tree topper. In such a case, one or more pieces of the fill material 70 can be inserted between the extension member 20 and the underside of the tree topper 80 in order to stabilize and prevent wobbling of the tree topper to more securely connect the extension member and the tree topper.

Figure 7:
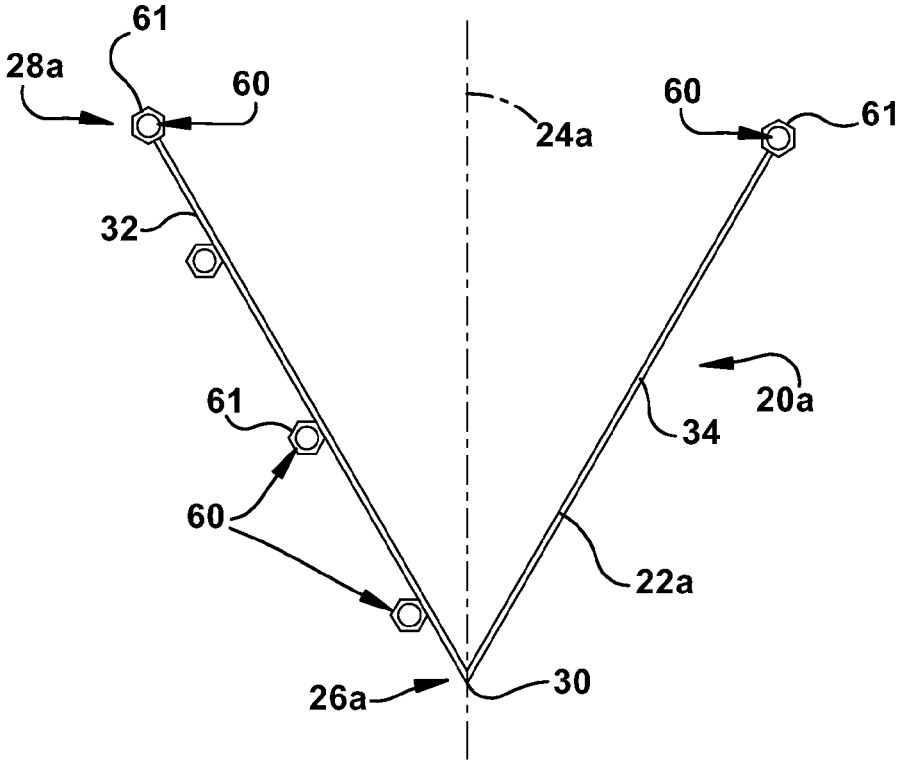
FIG. 7 illustrates an alternative example configuration for the tree topper extension.

An alternative example of an extension member **20*a* is illustrated in FIG. 7. Features in FIG. 7 that are the same as features in FIGS. 1-6 are given the same reference numeral whereas features in FIG. 7 that are different from features in FIGS. 1-6 are given the suffix "a". In FIG. 7, the body 22*a* of the extension member 20*a* is formed in a U or V-shape. In particular, the body 22*a* is formed or bent about a vertex 30 to define a pair of legs 32, 34 of the body. The legs 32, 34 may be symmetric or asymmetric (not shown) about the centerline 24*a* of the body 22*a*. The extension member 20*a* is secured to the top 104 of the tree 100 in the same manner as the extension member 20. The extension member 20*a* may be secured to the tree 100 with the V-shape pointing in an upward, downward or sideways direction. The tree topper 80 is then placed on the extension member 20*a* and stabilized with the fill material 70**.

Figure 8:
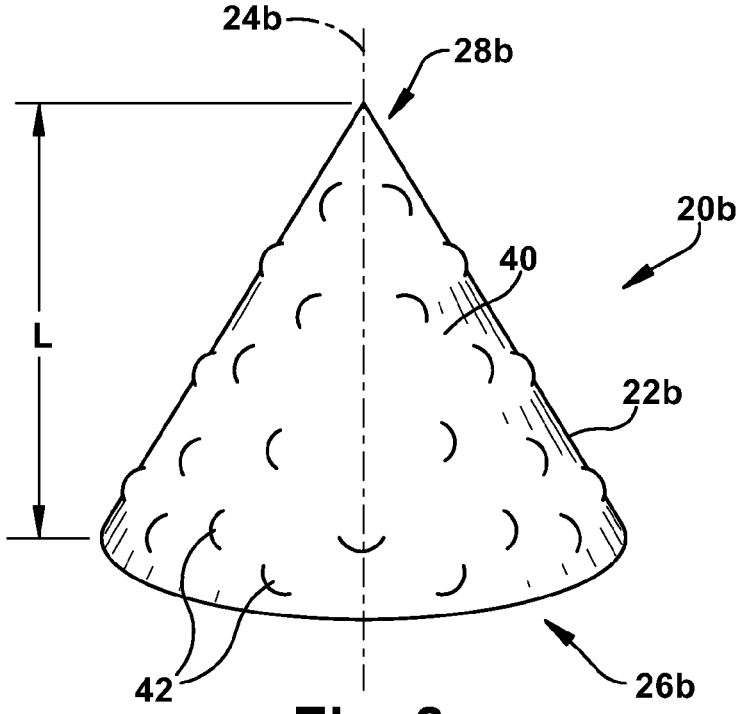
FIG. 8 illustrates another alternative example configuration for the tree topper extension.

Another alternative example of an extension member **20*b* is illustrated in FIG. 8. Features in FIG. 8 that are the same as features in FIGS. 1-6 are given the same reference numeral whereas features in FIG. 8 that are different from features in FIGS. 1-6 are given the suffix "b". In FIG. 8, the base 22*b* of the extension member 20*b* is formed into a conical or frusto-conical shape. The base 22*b* of the extension member 20*b* can be formed from a rigid sheet of material that can be for example, solid, meshed, latticed, grid or spiral-patterned. The conical base 22*b* includes an outer surface 40 in which the proximal end 26*b* is located at the wider diameter portion and the distal end 28*b* is located at the smaller diameter portion. The length L along the centerline 24*b* of the base 22*b* is substantially equal to the expected interior length of the tree topper 80** to be used.

A series of protruding elements (e.g., barbs or ribs) 42 may be provided on the outer surface 40 of the base **22*b* to help secure the extension member to the interior surface of the tree topper 80. The protruding elements 42 may be integrally formed with or secured to the outer surface 40 of the base 22*b* and extend outwardly from the outer surface. As an example, the ribs 42 may be formed on a sheet (not shown) that is adhered or fastened to the outer surface 40 of the base 22*b*. The extension member 20*b* is secured to the top 104 of the tree 100 in the same manner as the extension member 20. The tree topper 80 is then placed over the outer surface 40 such that the ribs 42 engage the interior or underside of the tree topper. If needed, fill material 70 can be placed in any gaps between the tree topper 80 and the outer surface 40** to stabilize the tree topper relative to the tree.

Figure 9:
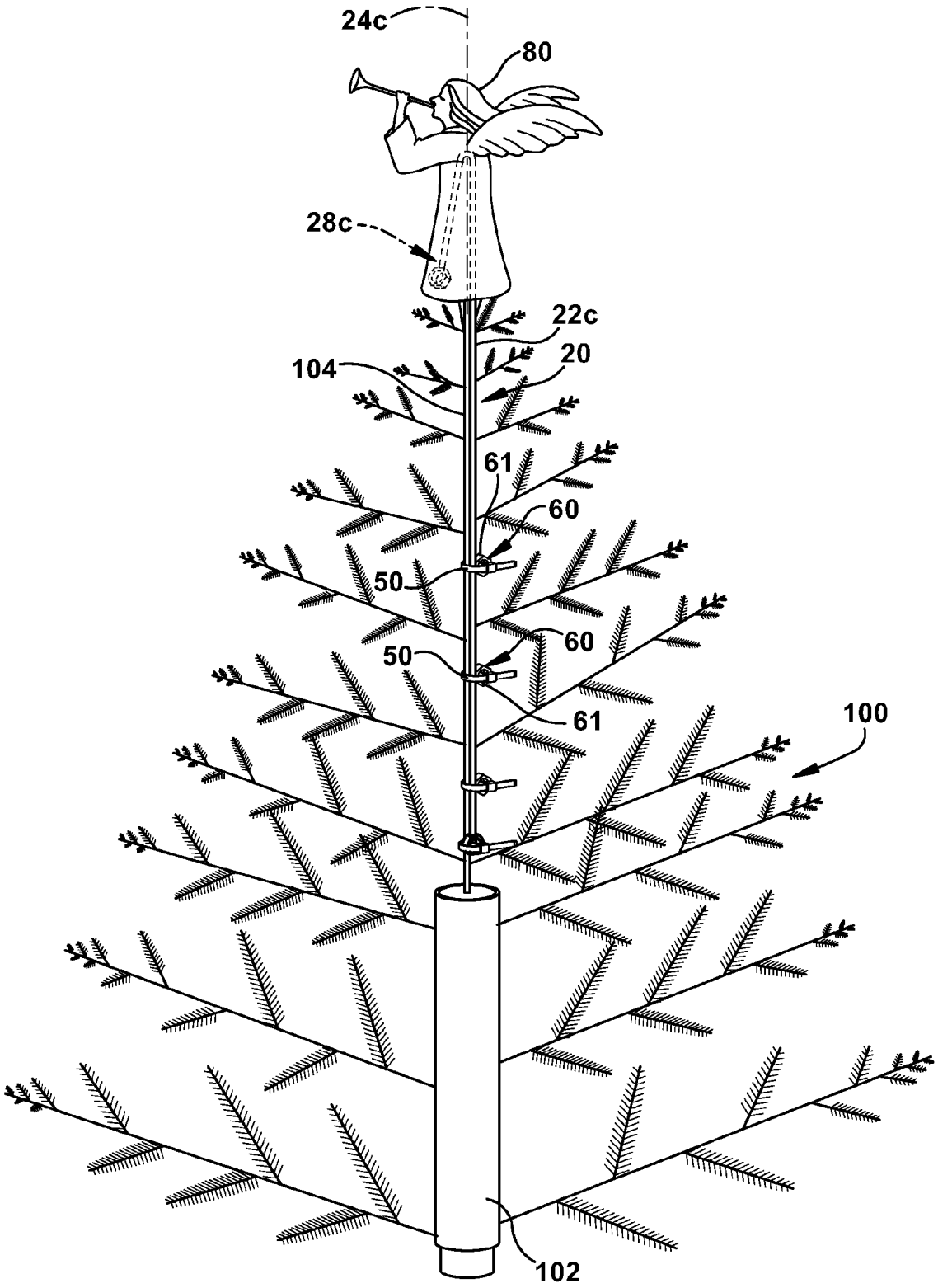
FIG. 9 illustrates another alternative example configuration for the tree topper extension mounted at the top of a tree.

Another alternative example of an extension member **20*c* is illustrated in FIG. 9. Features in FIG. 9 that are the same as features in FIGS. 1-6 are given the same reference numeral whereas features in FIG. 9 that are different from features in FIGS. 1-6 are given the suffix "c". In FIG. 9, the distal end 28*c* of the base 22*c* of the extension member 20*c* is bent downwards towards the proximal end 26 at an angle, such as to accommodate the inside diameter or shape of the tree topper 80. The distal end 28*c* can include additional bends in order to accommodate various tree toppers 80. In this way, the extension member 20*c* can itself operate as fill material to help hold the tree topper 80** in a desired orientation.

What has been described above are examples and embodiments of the invention. It is, of course, not possible to describe every conceivable combination of components or methodologies for purposes of describing the invention, but one of ordinary skill in the art will recognize that many further combinations and permutations of the invention are possible. Accordingly, the invention is intended to embrace all such alterations, modifications and variations that fall within the scope of the appended claims and the application.

What is claimed is:

1. A kit for securing a tree topper to a tree comprising:

an extension member for receiving the tree topper including an elongate body portion having a first end and a second end with an axis extending through the first end and the second end along a leg of the elongate body portion that is between the first end and the second end, the leg of the elongate body portion including at least two openings that are positioned axially spaced apart from each other located at fixed axial locations along the leg of the elongate body portion and positioned between the first end and the second end of the leg of the elongate body portion, wherein at least one of the at least two openings one of extends in a direction that is offset radially from the axis extending through the first end and the second end along the leg of the elongate body portion and extends through the extension member; and at least one fastener comprising a flexible material that extends through at least one of the openings and is sufficiently pliant to form an annular shape around a portion of the tree to secure the extension member to the tree.

2. The kit recited in 1 further comprising fill material for placement between the tree topper and the extension member to inhibit relative movement between the extension member and the tree topper.

3. The kit recited in 1, wherein the first end of the elongate body portion is secured to the tree and the second end of the elongate body portion is secured to the tree topper.

4. The kit recited in 1, wherein the at least one fastener comprises a releasable fastener to facilitate attachment to and removal from the tree.

5. The kit recited in 1, wherein the at least one fastener comprises one of a zip-tie, a wire, a clip, a clamp, and a twist-tie.

6. The kit recited in 1, wherein the body of the extension member has one of a conical shape and a frusto-conical shape.

7. The kit recited in 6, wherein the body has an outer surface that includes protruding elements for inhibiting relative movement between the extension member and the tree topper.

8. The kit recited in 1, wherein the fill material comprises an artificial tree branch.

9. The kit recited in 1, wherein the openings are provided in loops that are secured to the body.

10. A method of positioning a tree topper on a top of a tree using the kit of 1, the method comprising:

providing the extension member;

inserting the fastener through the at least one of the openings to secure the extension member to the tree; and placing the tree topper on the extension member to position the tree topper on top of the tree.

11. The method of 10, further comprising placing fill material between the tree topper and the extension member to inhibit relative movement between the extension member and the tree topper.

12. The method of 10, further comprising inserting fasteners through at least two of the openings to secure the extension member to the tree.

13. The method of 10, wherein the fastener being inserted through the opening and around a trunk of the tree.

14. The method of 10, wherein the tree is an artificial tree or a real tree.

15. The kit recited in 1, wherein the elongate body portion of the extension member is bent about a vertex defining one of a U-shape and a V-shape.

16. The kit recited in 1, wherein the at least two openings and the elongate body portion of the extension member comprise a unitary structure.

17. The kit recited in 1, wherein the at least two openings comprise an aperture having a diameter greater than the diameter of the elongate body portion.

18. A kit for securing a tree topper to a tree comprising:

an extension member for receiving the tree topper including an elongate body portion having a first end and a second end with an axis extending through the first end and the second end along a leg of the elongate body portion that is between the first end and the second end, the leg of the elongate body portion including at least two openings that are positioned axially spaced apart from each other located at fixed axial locations along the leg of the elongate body portion and positioned between the first end and the second end of the leg of the elongate body portion, wherein at least one of the at least two openings one of extends in a direction that is offset radially from the axis extending through the first end and the second end along the leg of the elongate body portion and extends through the extension member; and at least one fastener comprising a flexible material that extends through at least one of the openings and is sufficiently pliant to extend around at least a substantial portion of the tree to secure the extension member to the tree.

19. The kit recited in 18, wherein the extension member is bent about a vertex at the second end defining one of a U-shape and a V-shape, the elongate body portion further comprising another leg such that the leg of the elongate body portion defines the elongate body portion between the first end and the vertex and the other leg defines the elongate body portion between the vertex and another end.

* * * * *